US008469682B2

(12) United States Patent
Ramirez, Jr.

(10) Patent No.: US 8,469,682 B2
(45) Date of Patent: Jun. 25, 2013

(54) PERISTALTIC PUMP WITH TORQUE RELIEF

(75) Inventor: Emilio A. Ramirez, Jr., Roselle, IL (US)

(73) Assignee: Molon Motor and Coil Corporation, Arlington Heights, IL (US)

( * ) Notice: Subject to any disclaimer, the term of this patent is extended or adjusted under 35 U.S.C. 154(b) by 327 days.

(21) Appl. No.: 12/884,899

(22) Filed: Sep. 17, 2010

(65) Prior Publication Data

US 2011/0058969 A1 Mar. 10, 2011

Related U.S. Application Data

(63) Continuation-in-part of application No. 12/820,307, filed on Jun. 22, 2010, which is a continuation-in-part of application No. 12/283,930, filed on Sep. 17, 2008, and a continuation-in-part of application No. 11/197,381, filed on Aug. 5, 2005, now abandoned.

(51) Int. Cl.
*F04B 45/06* (2006.01)

(52) U.S. Cl.
USPC ..... 417/477.1; 417/475

(58) Field of Classification Search
USPC ..... 417/475, 477.1
See application file for complete search history.

(56) References Cited

U.S. PATENT DOCUMENTS 3,217,963 A 11/1965 Alsman
3,549,279 A 12/1970 Grach
3,601,306 A 8/1971 Martens et al.
3,756,752 A 9/1973 Stenner
3,942,915 A 3/1976 Thomas
4,365,728 A 12/1982 Tokorozawa et al.
4,392,790 A 7/1983 Shibata et al.
4,496,295 A 1/1985 King
4,513,796 A 4/1985 Miller et al.
4,515,584 A 5/1985 Abe et al.
4,540,350 A * 9/1985 Streicher ..... 417/475
4,573,887 A 3/1986 Smith
4,631,008 A 12/1986 Stenner
4,661,045 A 4/1987 Winston et al.
4,755,109 A 7/1988 Botts
5,031,258 A 7/1991 Shaw
5,054,947 A 10/1991 Frank et al.
5,281,111 A 1/1994 Plambeck et al.
5,326,236 A * 7/1994 Kramer et al. ..... 417/476
5,356,267 A 10/1994 Fulmer
5,390,385 A 2/1995 Beldham
5,403,277 A 4/1995 Dodge et al.
5,551,850 A 9/1996 Williamson et al.
5,628,731 A 5/1997 Dodge et al.
5,781,942 A 7/1998 Allen et al.
5,981,289 A 11/1999 Wright et al.

(Continued)

*Primary Examiner* — Charles Freay
*Assistant Examiner* — Patrick Hamo
(74) *Attorney, Agent, or Firm* — Bishop & Diehl, Ltd.

(57) ABSTRACT

A peristaltic pump for dispensing liquid is described and includes a front housing and a rear housing snap-fitted together to define a chamber having a recessed area and a rotor confined therein, a plurality of rollers mounted in the rotor, and a flexible tube compressed at equally spaced intervals by the plurality of rollers. The rotor undergoes a gradual increase in torque as a benefit of the recessed area, rather than an immediate high-torque load at the start of each pump cycle. Further, the pump is resistant to constant torques and vibrations caused by a machine to which it is attached so that the pump does not become loose and fall apart.

9 Claims, 8 Drawing Sheets

U.S. PATENT DOCUMENTS

| | | | |
|---|---|---|---|
| 6,077,246 | A | 6/2000 | Kullas et al. |
| 6,210,101 | B1 | 4/2001 | Horng |
| 6,386,844 | B1 | 5/2002 | Chen et al. |
| 6,436,072 | B1 | 8/2002 | Kullas et al. |
| 6,557,729 | B2 | 5/2003 | Gauthier |
| 6,857,295 | B2 | 2/2005 | Hansen et al. |
| 2002/0195069 | A1 | 12/2002 | Herke et al. |
| 2005/0127104 | A1 | 6/2005 | Tu |

* cited by examiner

PERISTALTIC PUMP WITH TORQUE RELIEF

RELATED APPLICATIONS

The present application is a continuation-in-part and claims the filing benefit of U.S. patent application Ser. No. 12/820,307, titled "Peristaltic Pump" filed on Jun. 22, 2010, which is a continuation-in-part of U.S. patent application Ser. No. 12/283,930 titled "Fluid Pump Systems" filed on Sep. 17, 2008, which is a continuation-in-part of U.S. patent application Ser. No. 11/197,381 titled "Peristaltic Pump" filed on Aug. 5, 2005. The '307, '930 and '381 applications are all incorporated herein by reference.

TECHNICAL FIELD OF THE INVENTION

The invention relates to peristaltic pumps, in particular to pumps for dispensing liquid detergent into a dish washing machine.

BACKGROUND OF THE INVENTION

Peristaltic pumps are well-known in the art and may be defined as pumps which produce pulse-like movement to push matter through a tube.

In FIG. 1, there is shown a prior art device that was manufactured by Knight Equipment International, Inc., of Costa Mesa, Calif., now Knight, Inc. of Northbrook, Ill.

Inside a casing 10, there is a pump 12 in which a triangular rotor 14 rotates to compress a flexible rubber tube 16 against a curved wall 30 at points A and B. These points A and B change along the length of the tube 16 as the rotor 14 rotates around its central axis 18. Three pins 20 hold three rollers 22 at tips X, Y and Z of the rotor 14 while four screws 24 hold front and back portions of the casing 10 together. The tube 16 has an inlet suction branch 16C and an outlet delivery branch 16D. Arrows I and 0 indicate the direction of flow of liquid detergent into and out of the tube 16. A clear, hard plastic cover 26 with a tab 28 allows a user to view and to have access to the interior of the casing 10 in order to replace or repair any parts of the pump 12 and the rotor 14 which may break.

One disadvantage of this prior art device is that the constant vibration of an industrial washing machine in which it is used tends over time to cause the screws 24 to work loose from the casing 10, thus causing the pump 12 inside to fail. Also, the constant vibration causes the pins 20 holding the rollers 22 in the rotor 14 to work loose and push up against the cover 26 until the cover 26 pops off. Once again the pump 12 fails. Thus, it is a problem in the prior art to develop a peristaltic pump which is resistant to constant vibrations that eventually caused earlier devices to become loose and fail.

Another disadvantage is that a high-torque point may be created at the inlet end as a tip of the rotor 14 engages the tube 16 at point C. The motor (not shown) typically used to operate the rotor 14 is small and may not generate sufficient power to start the rotor 14 moving. Accordingly, if a larger powered motor is not used, the appliance may experience frequent motor burnout.

The present invention is designed to overcome these and other problems associated with prior art peristaltic pumps.

SUMMARY OF THE INVENTION

The invention may be summarized as a small screwless peristaltic pump which is resistant to constant vibrations caused by a machine to which it is attached so that the pump does not become loose and fall apart.

It is an object of an embodiment of the present invention to hold the peristaltic pump together without the use of screws. A key advantage of the present invention is that only a predetermined amount of the liquid detergent enters the pump because the synchronous motor, as controlled electronically, meters the detergent to prevent waste in the dish washing machine.

It is also an object of an embodiment of the present invention to provide torque relief for the pump at start-up to prevent motor burnout. A recessed area within the pump casing at the inlet allows a more gradual compression of the tube, thereby decreasing the torque required to begin each pump cycle.

BRIEF DESCRIPTION OF THE DRAWINGS

The invention and its other advantages may be best understood by reference to the accompanying drawings and the subsequent detailed description of the preferred embodiments.

DETAILED DESCRIPTION OF THE INVENTION

For the pump of FIGS. 1-8, there are two basic preferred embodiments: a first embodiment for low torque and low vibration operations; and a second embodiment for high torque and high vibration operations.

Figure 2:
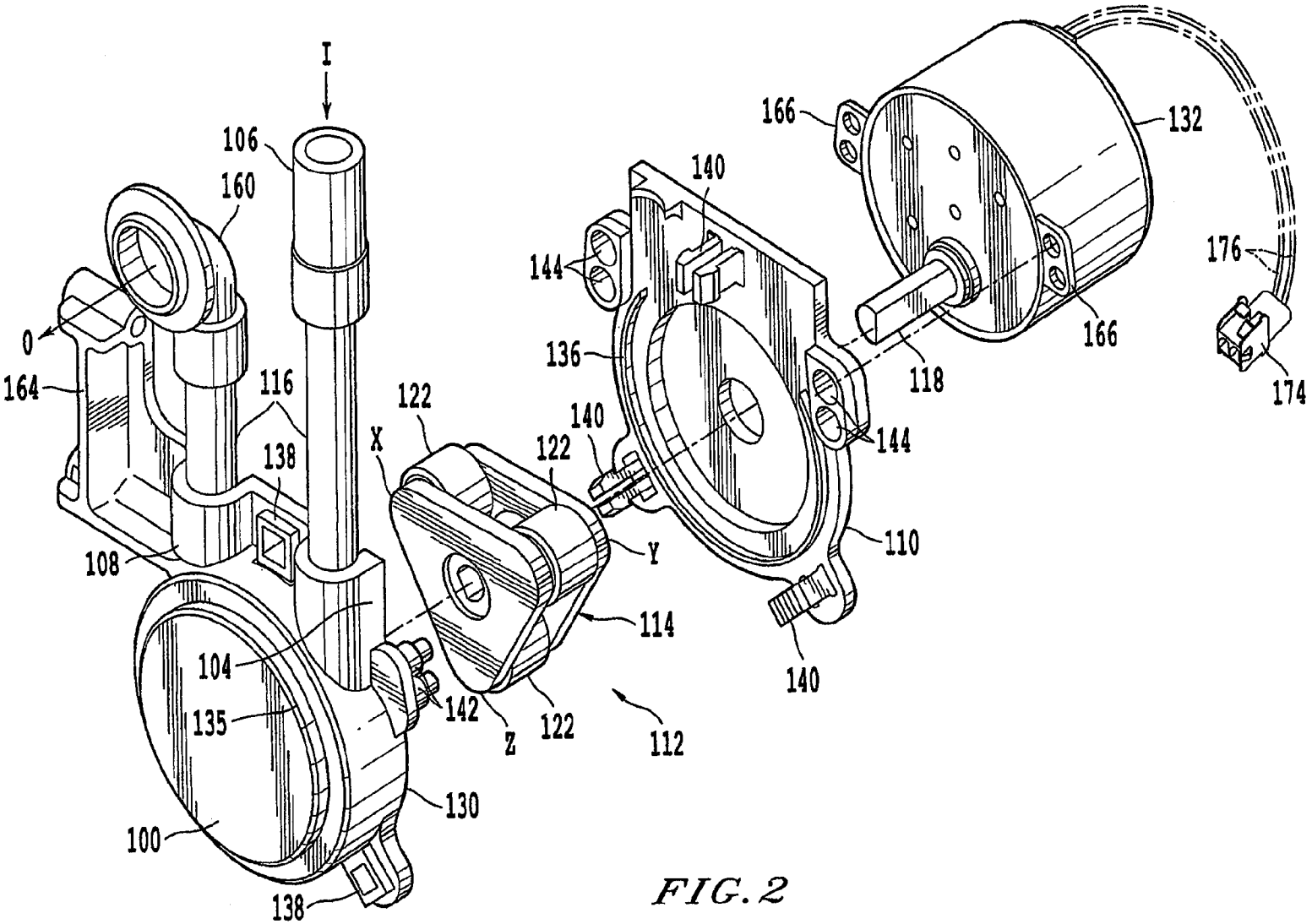
FIG. 2 is an exploded front perspective view of a first embodiment of the invention.

In FIG. 2, the first embodiment is illustrated. There is a small plastic peristaltic pump 112 contained in a main housing which has a front housing 100 and a cover or a rear housing 110. The front housing 100 and the rear housing 110 are snap-fitted together in a manner described below. A bracket 164 is formed integrally with a side of the front housing 100. This bracket 164 attaches the main housing containing the pump 112 to a dish washing machine (not shown). An electrical plug 174 allows alternating current to be carried through wires 176 from an activator (not shown) when it is switched on by a user who desires to wash a load of dishes. Upon activation, an inlet suction branch 106 brings a predetermined amount of liquid detergent flowing from a reservoir (not shown) in a direction I into a flexible rubber U-shaped tube 116 held in place at an inlet to the pump 112 by a U-shaped inlet channel 104 integrally formed on a top surface of the front housing 100. Inside the pump 112, there is a plurality of plastic rollers 122 on tips X, Y and Z of a triangular plastic rotor 114 confined between the front housing 100 and the rear housing 110. The rollers 122 compress the flexible tube 116 at equally spaced intervals against an interior side of a curved wall 130. Although three rollers 122 are shown, a manufacturer may choose to use more or less rollers, for example, four or two rollers instead. Nevertheless, three rollers 122 are preferred. The rollers 122 are rolled along the flexible tube 116 as they are rotated by the rotor 114 which is turned by an output shaft 118 extending from a synchronous gear motor 132. Ears 166 project from opposite sides of the motor 132. Bosses 142 on an outer periphery of the front housing 100 extend through hollow cylindrical sleeves 144 into upper and lower holes in the ears 166 and are ultrasonically heated until they melt to spot weld the motor 132 to the rear housing 110.

As seen in FIG. 2, only a predetermined amount of the liquid detergent enters the pump 112 because the synchronous motor 132 meters the detergent to prevent waste in the dish washing machine. The amount of liquid is predetermined by the signal sent to the motor 132 which then turns its shaft 118 and the rotor 114 mounted thereon a predetermined number of times.

The motor 132 is rated at 120 volts of alternating current (AC) at 60 hertz (Hz). The rated current is 0.05 amps and the rated speed is 20 revolutions per minute (rpm), plus or minus 10%.

Pulse-like contractions are produced inside the flexible tube 116. These contractions propel the liquid detergent in spurts along the inside of the flexible tube 116 held in place at an outlet from the pump 112 by a U-shaped outlet channel 108 until the liquid detergent is dispensed by being squirted out of an outlet delivery branch 160 in a direction 0 into the dish washing machine (not shown). The U-shaped outlet channel 108 is formed integrally on a top surface of the front housing 100.

Figure 1:
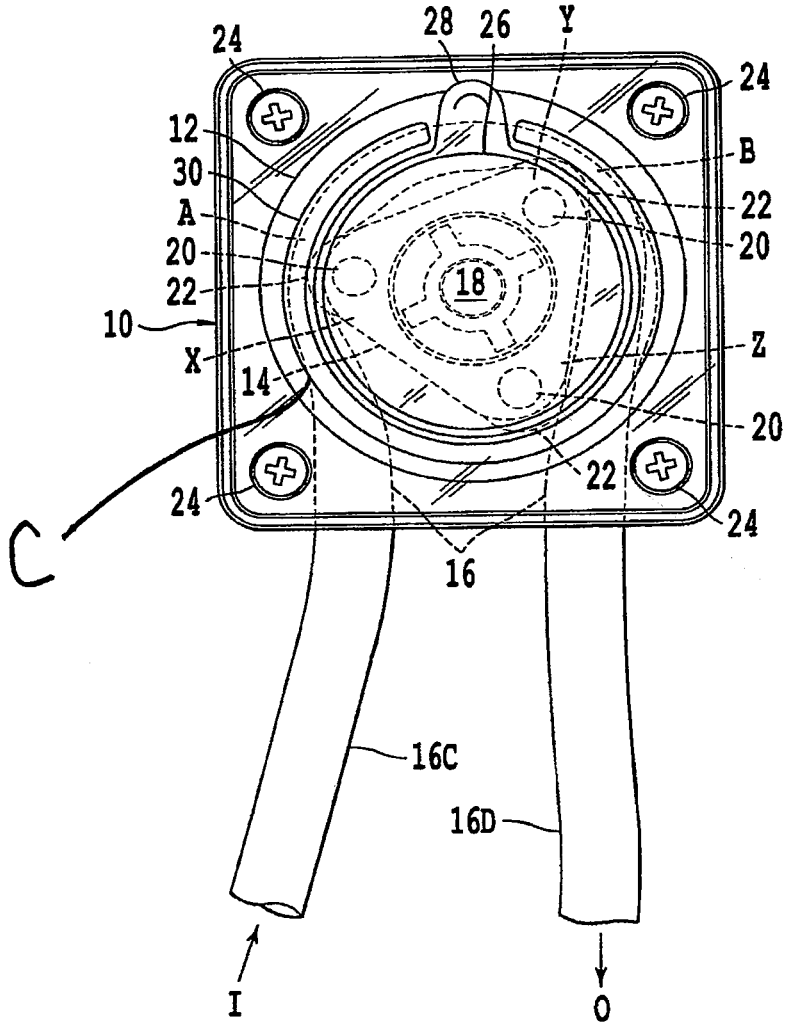
FIG. 1 PRIOR ART
FIG. 1 is a front elevation view of a known prior art device.

Instead of the metal pins used in the prior art device shown in FIG. 1, the pump 112 in FIG. 2 is secured together against the constant vibrations of the dish washing machine by three types of plastic devices for snap-fitting the front housing 100 together with the cover or rear housing 110. The first type is a C-shaped groove (not shown) in a circular recess 135 into which a C-shaped tongue 136 is inserted. In an alternate embodiment, at least a pair of straight grooves and a mating pair of straight tongues 136 may be used. The second type of plastic device is a trio of square, open-ended boxes 138 into which a trio of springy, plastic clip pairs 140 are inserted. At least two of these boxes 138 and clip pairs 140 are needed for the front housing 100 and the rear housing 110 to be snap-fitted together. The third type of plastic device is the pair of bosses 142 on each side of the front housing 100. The bosses 142 are inserted through the pair of hollow cylindrical sleeves 144. In an alternate embodiment, only one boss 142 and one sleeve 144 may be used. Note that the groove in the recess 135, the boxes 138 and the bosses 142 are positioned on an outer periphery of the front housing 100 while the tongue 136, the clip pairs 140 and the sleeves 144 are positioned on an outer periphery of an interior wall of the rear housing 110. However, in an alternate embodiment, the groove in the recess 135, the boxes 138 and the bosses 142 may be positioned on the rear housing 110 while the tongue 136, the clip pairs 140 and the sleeves 144 may be positioned on the front housing 100. An ultrasonic welding rod (not shown) is applied to three areas on an exterior wall of the rear housing 110 where the bosses 142 are inserted through the sleeves 144 into the ears 166 in order to heat and melt each boss 142 into its aligned sleeve 144 and ear 166 so that the boss 142, the sleeve 144 and the ear 166 are fused together. Thus, the pump 112 is not jarred apart by the constant vibrations caused by the dish washing machine.

Figure 3:
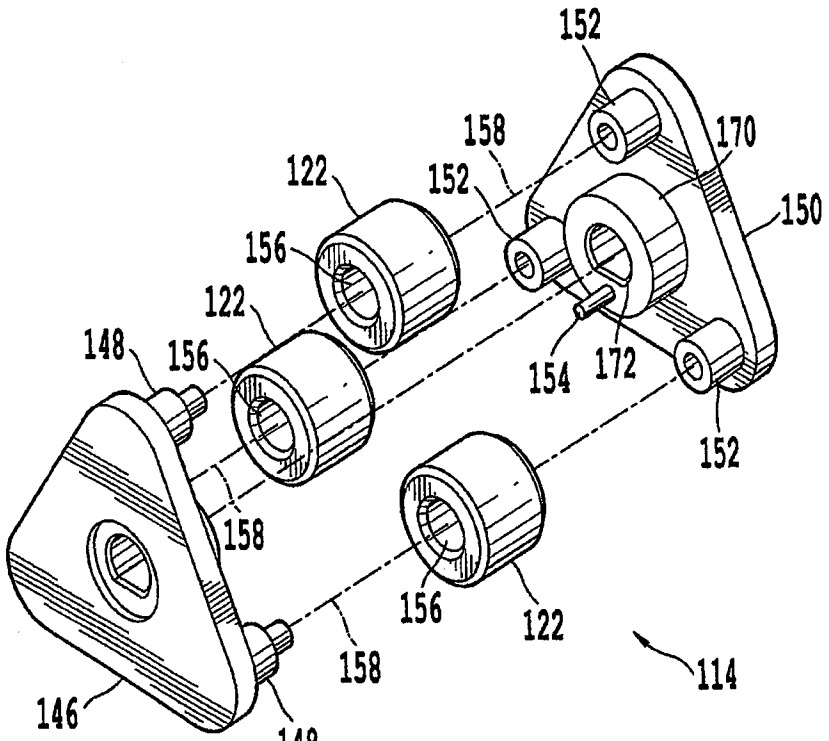
FIG. 3 is an exploded front perspective view of a rotor and rollers inside the first embodiment.

In FIG. 3, the triangular rotor 114 for low torque and low vibration operations is illustrated. The rotor 114 and its rollers 122 are exploded apart to show how they are connected together. A front face 146 of the rotor 114 has formed integrally on its inner side three stepped male inserts 148. A rear face 150 has formed integrally on its inner side three aligned cylindrical barrels 152 with which the male inserts 148 mate. Each roller 122 has a cylindrical bore 156 through its center along its longitudinal axis 158. Note that a dowel 154 is mounted inside the rotor 114 and aligns the plurality of mated inserts 148 and barrels 152 around a central D-shaped bore 172. A single central large cylindrical barrel 170 carries the dowel 154 and surrounds the D-shaped bore 172 through which the shaft 118 of FIG. 2 with its D-shaped cross section passes in order to rotate the rotor 114.

In FIG. 3, the rotor 114 is assembled in the following manner. First, the rollers 122 are slipped onto the barrels 152. Second, the inserts 148 are plugged into the bores 156 of the barrels 152 so that the mated inserts 148 and the barrels 152 carry the rollers 122. Simultaneously, the dowel 154 is inserted into a bore (not shown) made in the inner side of the front face 146. An ultrasonic welding rod (not shown) is applied to three areas on an outer side of the rear face 150 where the inserts 148 are plugged into the barrels 152 so that the inserts 148 and the barrels 152 are fused together. However, care must be taken so that too much heat is not applied in order to prevent the rollers 122 on the barrels 152 from being deformed.

Figure 4:
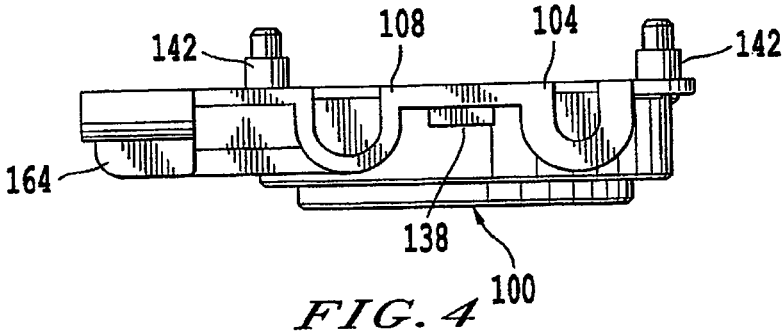
FIG. 4 is a top end view of a front portion of a casing of the first embodiment.
Figure 5:
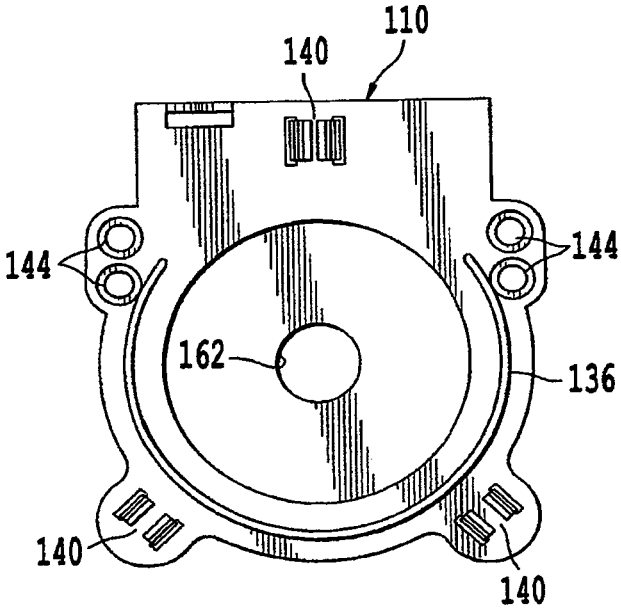
FIG. 5 is a front inside elevational view of a back portion of the casing of the first embodiment.

In FIG. 4, there is shown a top end view of the front housing 100 which functions as part of the main housing for both the first and second embodiments. The U-shaped inlet channel 104 secures an entrance for the flexible tube (not shown) while the U-shaped outlet channel 108 secures an exit for the flexible tube. A top of one box 138 is also seen. In the first embodiment for low torque and low vibration operations, a pair of bosses 142 on each side, of which only the top boss 142 is seen, is insertable through the pair of hollow cylindrical sleeves 144 on each side shown in FIG. 5 on the interior wall of the rear housing 110. In FIG. 4, the bracket 164 attaches the front housing 100 to the dish washing machine (not shown). The front housing 100 is also secured to the rear housing 110 of FIG. 5 by the trio of clip pairs 140 which are inserted into the boxes 138 of FIG. 4, of which only one box 138 is shown in FIG. 4. Likewise, in FIG. 5, the circular tongue 136 arranged on the interior wall of the rear housing 110 is inserted into the groove (not shown in FIG. 4, but see the back of the groove in the recess 135 illustrated in FIG. 2). In FIG. 5, an opening 162 through the center of the rear housing 110 allows the output shaft 118 seen in FIG. 2 to extend there through to engage with and drive the rotor 114 of FIG. 3.

Figure 6:
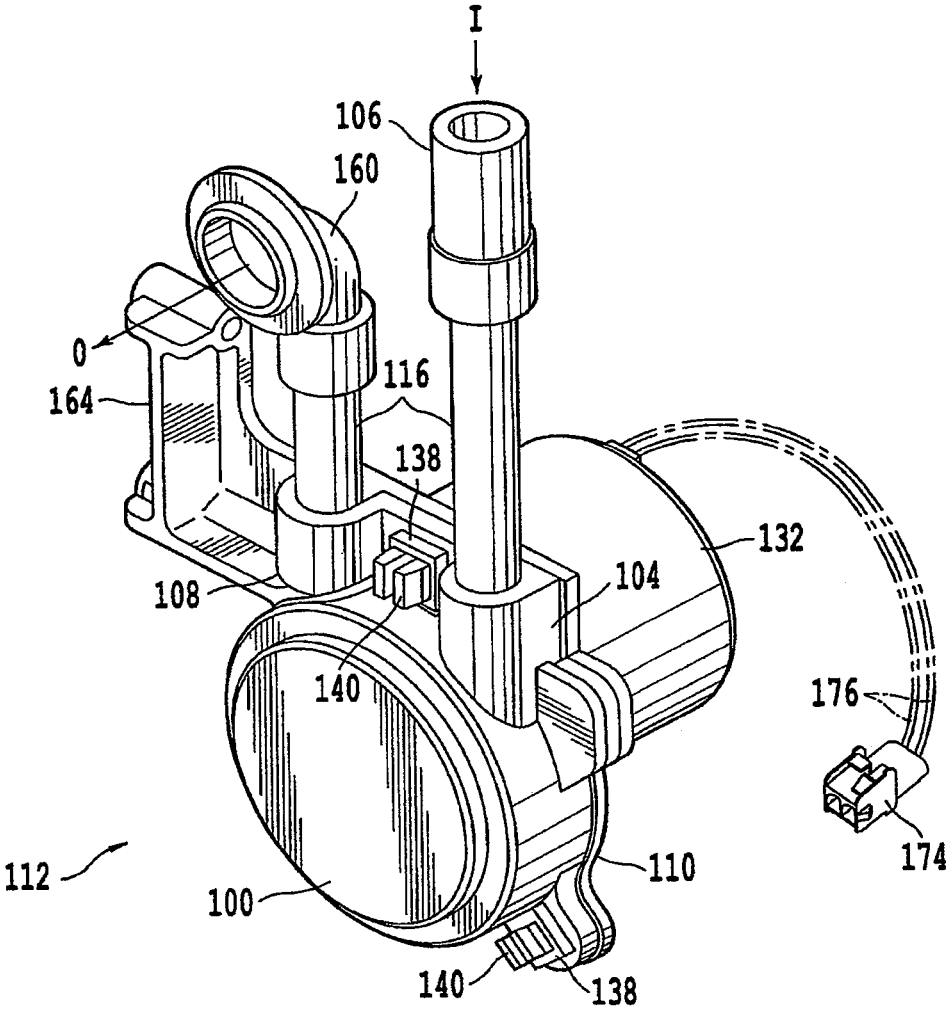
FIG. 6 is an assembled perspective view of the first embodiment.

In FIG. 6, the pump 112 is shown to be assembled with the motor 132. The operation of the pump 112 and the motor 132 in this first embodiment may be understood by following the path of movement of the liquid there through. Note that the liquid may be other than a detergent. Initially, the motor 132 is turned on when it receives a signal through the wires 176 of the plug 174 to meter the flow of liquid in the direction I into the inlet suction branch 106 which leads to the flexible tube 116 that is held securely by the U-shaped inlet channel 104. To prevent waste of liquid detergent in the dish washing machine, the signal energizes the motor 132 to turn its shaft 118 seen in FIG. 2 a predetermined number of times depending upon whether a small, medium or large amount of detergent is needed to clean the load in the dish washing machine. A predetermined amount of the liquid then enters the pump 112 where the rollers 122 of FIGS. 2 and 3 intermittently compress the flexible tube 116 so that the even flow of liquid is converted into pulses of liquid. These liquid pulses exit the pump 112 through the flexible tube 116 that is held securely by the U-shaped outlet channel 108. The liquid is then squirted out of the outlet delivery branch 160 in the direction 0 into the dish washing machine (not shown). While the rotor 114 of FIGS. 2 and 3 is driven by the motor 132, the pump 112 is seen in FIG. 6 to be held together by the front housing 100 and the rear housing 110 which are secured by the two clip pairs 140 in the two boxes 138. Another clip pair 140 in its box 138 is hidden from view. The pairs of sleeves 144 on the rear housing 110 and the pairs of bosses 142 on the front housing 100 stuck therein are also hidden from view. In this first embodiment for low torque and low vibration operations, the groove in the recess 135 and its mating tongue 136 of FIG. 2 are not illustrated in FIG. 6 because they are hidden inside the front housing 100 and the rear housing 110, respectively. The bracket 164 is shown for attaching the entire assembly to the dish washing machine (not shown).

Note in FIG. 2 that there are no screws holding the pump 112 together with its housing which includes the front housing 100 and the rear housing 110. Also, in this first embodiment for low torque and low vibration operations, there are no screws supporting the motor 132 onto the exterior wall of the rear housing 110. Note further that the pump 112, the rollers 122 and the tube 116 are all impervious to deleterious ingredients contained in the liquid detergent.

Figure 7:
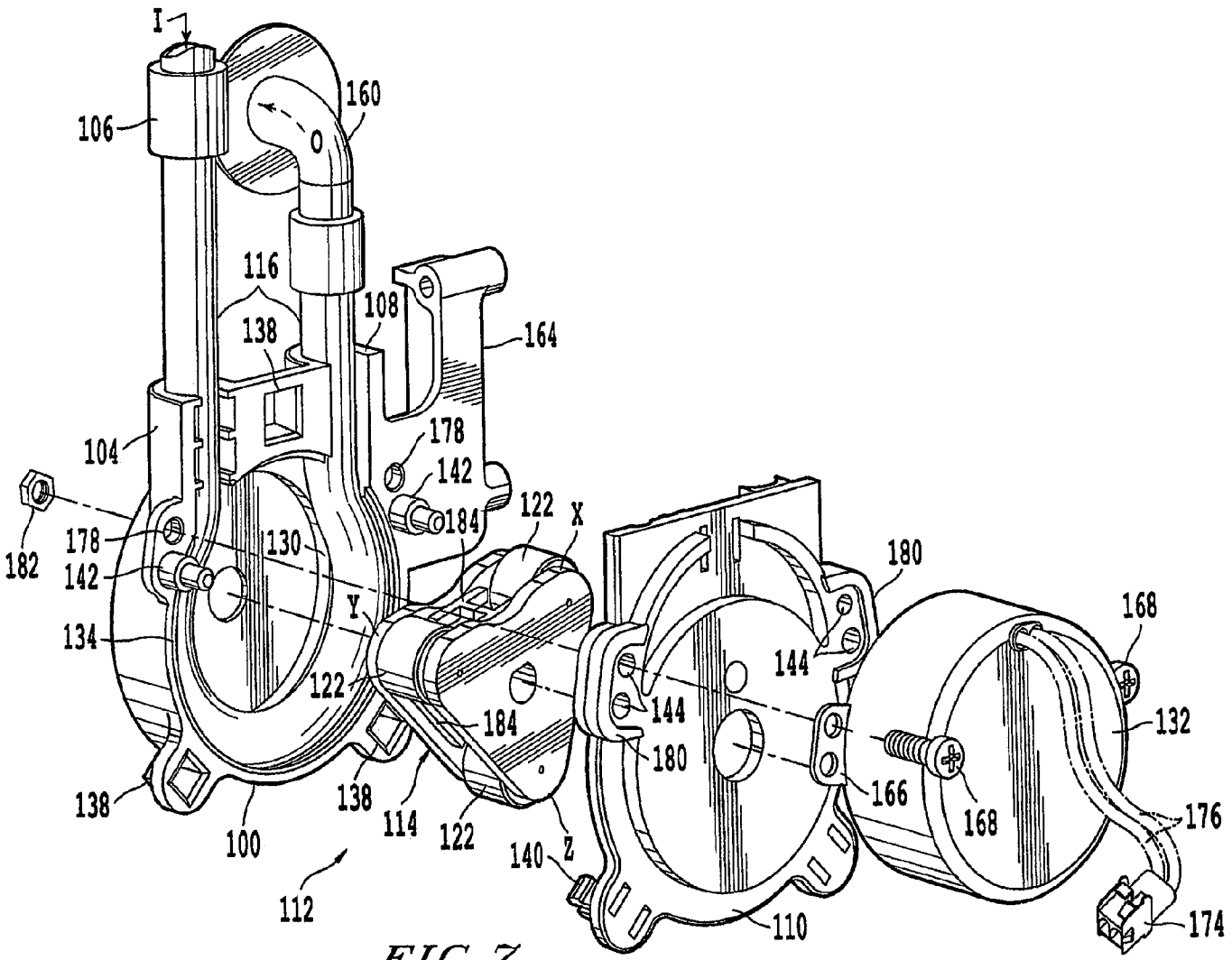
FIG. 7 is an exploded rear perspective view of a second embodiment of the invention.

In FIG. 7, the second embodiment for high torque and high vibration operations is illustrated. The pump 112 is contained in the main housing which has the front housing 100 and the cover or rear housing 110. The front housing 100 and the rear housing 110 are snap-fitted together in the manner described below. The bracket 164 is formed integrally with a side of the front housing 100 and attaches the main housing containing the pump 112 to the dish washing machine (not shown). The electrical plug 174 allows alternating current to be carried through the wires 176 from the activator (not shown) when it is switched on by a user. Upon activation, the inlet suction branch 106 brings a predetermined amount of liquid detergent flowing from a reservoir (not shown) in the direction I into the flexible tube 116 held in place at the inlet to the pump 112 by the U-shaped channel 104 integrally formed on the top surface of the front housing 100. Inside the pump 112, there is a plurality of rollers 122 on tips X, Y and Z of the rotor 114 confined between the front housing 100 and the rear housing 110. The rollers 122 compress the flexible tube 116 at equally spaced intervals against the interior side of the curved wall 130. The rollers 122 are rolled along the flexible tube 116 as they are rotated by the rotor 114 which is turned by the output shaft 118 (not shown but see FIG. 2) extending from the motor 132. Ears 166 of which only one is seen in FIG. 7, project from opposite sides of the motor 132. Screws 168 are inserted into upper holes in the ears 166, extend through the upper sleeves 144 on the rear housing 110 and pass through bores 178 in the front housing 100 where the screws 168 are secured at their ends by bolts 182 of which only one is shown. The bosses 142 extend from the front housing 100 through the lower sleeves 144 into the lower holes in the ears 166 and are ultrasonically heated until they melt to spot weld the motor 132 to the rear housing 110. Of course, in an alternate embodiment, the screws 168 may be inserted into the lower holes in the ears 166 and the bosses 142 may be extended through the upper holes in the ears 166 to achieve the same result. Note that this combination of screws 168 and bosses 142 is intended for high torque and high vibration operations.

Pulse-like contractions are produced inside the flexible tube 116 as the rotor 114 rotates the rollers 122 along the curved wall 130 to compress the tube 116. These contractions propel the liquid detergent in spurts along the inside of the tube 116 which is held in place at the outlet from the pump 112 by the U-shaped channel 108 until the liquid detergent is dispensed by being squirted out of the delivery branch 160 in the direction 0 into the dish washing machine (not shown). The channel 108 is formed integrally on a top surface of the front housing 100.

Instead of the metal pins used in the prior art device shown in FIG. 1, the pump 112 in FIG. 7 is secured together against the constant vibrations of the dish washing machine by three types of plastic devices for snap-fitting the front housing 100 together with the cover or rear housing 110. The first type is the C-shaped groove 134 into which the C-shaped tongue 136 (see FIG. 2) is inserted. In an alternate embodiment, at least a pair of straight grooves 134 and a mating pair of straight tongues 136 may be used. The second type of plastic device is the trio of square boxes 138 into which a trio of springy clip pairs 140 are inserted. Only one pair of the clips 140 is seen in FIG. 7. At least two of these boxes 138 and clip pairs 140 are needed for the front housing 100 and the rear housing 110 to be snap-fitted together. The third type of plastic device is the pair of bosses 142, one on each side of the front housing 100. The bosses 142 are inserted through the lower sleeves 144 into the lower ears 166 on the motor 132. Note that the groove 134, the boxes 138 and the bosses 142 are positioned on an outer periphery of the front housing 100 while the tongue 136 (not shown in FIG. 7 but see FIG. 2), the clip pairs 140 and the sleeves 144 are positioned on an outer periphery of an interior wall of the rear housing 110. However, in an alternate embodiment, the groove 134, the boxes 138 and the bosses 142 may be positioned on the rear housing while the tongue 136 of FIG. 2, the clip pairs 140 and the sleeves 144 may be positioned on the front housing 100. An ultrasonic welding rod (not shown) is applied to three areas on the exterior wall of the rear housing 110 where the bosses 142 are inserted through the lower sleeves 144 into the lower holes in the ears 166 in order to heat and melt each boss 142 into its aligned lower sleeve 144 and lower hole of the ear 166 so that the boss 142, the sleeve 144 and the ear 166 are fused together. Thus, the pump 112 is not jarred apart by the constant vibrations caused by the dish washing machine.

In this second embodiment shown in FIG. 7, there is a skirt 180 at least partially surrounding the sleeves 144 on each side of the rear housing 110 to form a recessed area into which the ears 166 may fit so as to prevent wobbling of the motor 132 when it is activated. There are also skirts 180 in the first embodiment for low torque and low vibration operations. However, the skirts 180 are not seen in the first embodiment because FIG. 2 is a front perspective view which hides the skirts 180.

Figure 8:
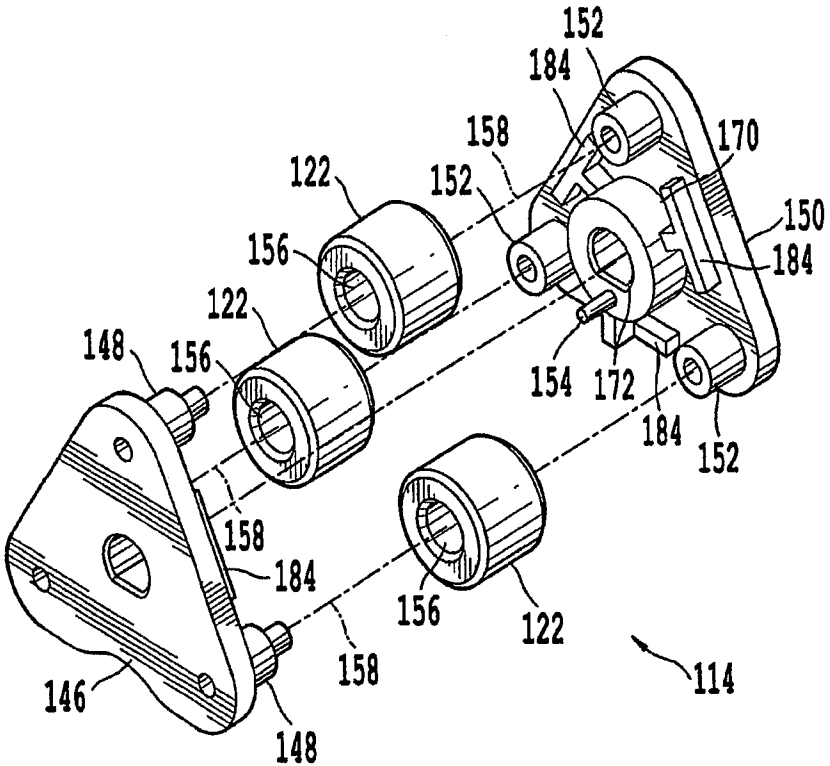
FIG. 8 is an exploded front perspective view of a rotor and rollers inside the second embodiment.

In FIG. 8, the triangular rotor 114 for high torque and high vibration operations is illustrated. Three T-shaped supports 184 reinforce the rotor 114 against high torque and high vibrations. In the first embodiment shown in FIG. 3 for low torque and low vibration operations, there are no T-shaped supports 184 reinforcing the rotor 114.

In FIG. 8, the rotor 114 and its rollers 122 are exploded apart to show how they are connected together. The front face 146 of the rotor 114 has formed integrally on its inner side three stepped male inserts 148. The rear face 150 has formed integrally on its inner side three aligned cylindrical barrels 152 with which the male inserts 148 mate. Each roller 122 has a cylindrical bore 156 through its center along its longitudinal axis 158. The dowel 154 is mounted inside the rotor 114 and aligns the plurality of mated inserts 148 and barrels 152 around the central D-shaped bore 172. The single central large cylindrical barrel 170 carries the dowel 154 and surrounds the D-shaped bore 172 through which the shaft 118 of FIG. 2 with its D-shaped cross section passes in order to rotate the rotor 114.

In FIG. 8, the rotor 114 is assembled in the following manner. First, the rollers 122 are slipped onto the barrels 152. Second, the inserts 148 are plugged into the bores 156 of the barrels 152 so that the mated inserts 148 and the barrels 152 carry the rollers 122. Simultaneously, the dowel 154 is inserted into a bore (not shown) made in the inner side of the front face 146. The ultrasonic welding rod (not shown) is applied to three areas on the outer side of the rear face 150 where the inserts 148 are plugged into the barrels 152 so that the inserts 148 and the barrels 152 are fused together. However, care must be taken so that too much heat is not applied in order to prevent the rollers 122 on the barrels 152 from being deformed.

Figure 9:
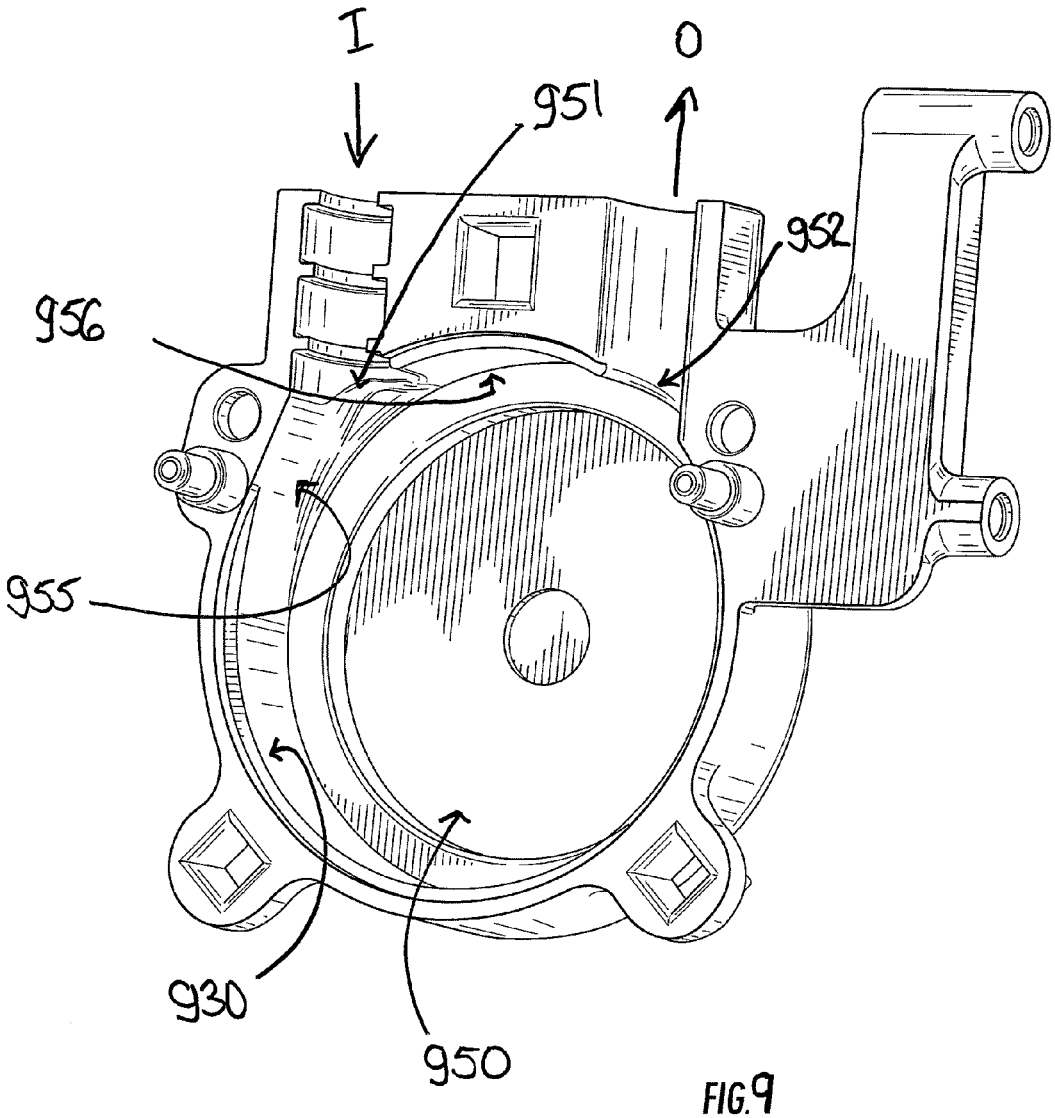
FIG. 9 is a perspective of one side of an interior of the pump chamber.

Referring now to FIG. 9, a third embodiment of the present peristaltic pump 112 may be more readily understood. The most significant change from the previous embodiments, as illustrated in front housing 900 of FIG. 9, occurs in the pump chamber 950. The pump chamber 950, substantially identical to that shown in the embodiment of FIG. 7, is comprised of a circular wall 930 which connects a tube inlet opening 951 and the tube outlet opening 952. The circular wall 930 is approximately 240 degrees in length measured from a central axis of the inlet opening 951 to a central axis of the outlet opening 952. Just after the tube inlet opening 951, the tubing 116 would be required to turn slightly outward at a shoulder. However, unlike previous embodiments, the current pump chamber 950 has a recessed area 955 to allow the tubing to make a less abrupt outward turn against the circular wall 930. More importantly, the rotor 114 is able to compress the tubing 116 more gradually at the recessed area as it moves about the chamber.

The recessed area 955 is in the range of from about 5 to about 25 mm in length, depending on the pump size. As mentioned, a key of the recessed area 955 feature of this embodiment is to provide a less abrupt shoulder at the inlet opening 951 to prevent binding—i.e., creating a high-torque moment—of the rotor 114 at the shoulder. As a rotor tip X, Y or Z travels from the free space 956 (i.e., the area of the chamber 950 where the tubing 116 does not reside), it does not bind against the tubing 116 and the shoulder of the circular wall 950 at the tubing inlet opening 951. As a result, the high-torque situation, which a typically small motor of the pump 112 may not be able to overcome, is avoided. In the present embodiment, the recessed area 955 allows each of the rotor tips X, Y and Z to gradually increase engagement with the tubing 116 against the circular wall 930, providing less motor burnout as a result.

Although the present invention has been described by way of preferred embodiments, other modifications will be realized by those persons skilled in this particular technology after reading this disclosure. However, these modifications may be considered within the scope of the appended claims if such modifications do not depart from the spirit of this invention.

What is claimed is:

1. A peristaltic pump for dispensing liquid, comprising:

a front housing;

a rear housing snap-fitted together with the front housing to form an interior chamber having a circular outer sidewall extending from a chamber inlet to a chamber outlet;

a rotor positioned within the chamber and rotatable around an axis, the rotor having aligned front and rear triangular-shaped faces and three rollers mounted and equidistantly-spaced between the aligned front and rear faces;

a flexible tube entering the chamber through the inlet and exiting through the outlet and being compressed by the three rollers against the outer sidewall separating the inlet and outlet, wherein the circular outer sidewall extending from the inlet to the outlet has an arc length sufficient to allow all three rollers to compress the tube simultaneously; and a torque relief zone defined by a tapered recessed area in the outer sidewall adjacent the chamber inlet, wherein the recessed area has a length in the range of about 5 to about 20 mm.

2. The peristaltic pump of claim 1, further comprising at least a pair of open-ended boxes and spring clip pairs configured to snap-fit together the front housing and the rear housing.

3. The peristaltic pump of claim 1, further comprising a bracket formed integrally with the front housing.

4. The peristaltic pump of claim 1, further comprising at least a pair of bosses and sleeves aligned and fused together by ultrasonic welding on the front housing and the rear housing.

5. The peristaltic pump of claim 1, further comprising an inlet channel formed integrally on the front housing and configured to hold the flexible tube in place.

6. The peristaltic pump of claim 1, further comprising a plurality of mated inserts and barrels formed integrally on the rotor and configured to carry the plurality of rollers.

7. The peristaltic pump of claim 1, further comprising T-shaped supports configured to reinforce the rotor.

8. The peristaltic pump of claim 1, wherein the flexible tube is continually compressed by at least two rollers.

9. A peristaltic pump for dispensing liquid, comprising:

a front housing;

a rear housing snap-fitted to the front housing to form a cylindrical chamber;

a rotor positioned within the cylindrical chamber and rotatable around an axis, the rotor having a plurality of rollers;

a snap-fit structure comprising:

a plurality of first snap-fit portions on the front housing and spaced apart from each other; and a plurality of second snap-fit portions on the rear housing and spaced apart from each other;

wherein each one of the first snap-fit portions is snap-fitted with a corresponding one of the second snap-fit portions;

a tapered recessed area having a length in the range of from about 5 to about 20 mm within the cylindrical chamber wall;

an elongated tongue extending longitudinally along one of the front and rear housings; and an elongated recess extending longitudinally along the other one of the front and rear housings;

wherein the elongated tongue extends into the elongated recess forming a seal and the front and rear housings are snap-fitted together at three or more angular locations around the axis.

* * * * *